US006396445B1

(12) United States Patent
Saitoh et al.

(10) Patent No.: US 6,396,445 B1
(45) Date of Patent: May 28, 2002

(54) WINDOW GLASS ANTENNA APPARATUS FOR VEHICLES

(75) Inventors: Masatoshi Saitoh, Machida (JP); Richard Langley, Chartham Hatch (GB); Hiroshi Endo, Tokyo (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 09/517,833

(22) Filed: Mar. 2, 2000

(30) Foreign Application Priority Data

Mar. 8, 1999 (JP) ..... 11-059984

(51) Int. Cl.[7] ..... H01Q 1/32
(52) U.S. Cl. ..... 343/713; 343/704
(58) Field of Search ..... 343/713, 860, 343/704, 711, 712; 219/203, 522, 543

(56) References Cited

U.S. PATENT DOCUMENTS 4,439,771 A * 3/1984 Kume et al. ..... 343/704
5,408,242 A 4/1995 Nakase ..... 343/704
5,905,468 A * 5/1999 Ikawa ..... 343/713
5,907,308 A * 5/1999 Oka et al. ..... 343/713
5,933,119 A * 8/1999 Fujii et al. ..... 343/713

FOREIGN PATENT DOCUMENTS

| | | |
|---|---|---|
| EP | 0 661 772 | 7/1995 |
| JP | 04 249403 | 9/1992 |

* cited by examiner

*Primary Examiner*—Don Wong
*Assistant Examiner*—Chuc Tran D
(74) *Attorney, Agent, or Firm*—Pennie & Edmonds LLP

(57) ABSTRACT

A window glass antenna apparatus for vehicles includes a defogger for defogging a window glass of a vehicle, which has bus bars at both ends and which is constituted of a thin, narrow strip conductor formed on the window glass such that the bus bars are opposed to a window metal frame of the vehicle with a predetermined gap therebetween, a driven antenna having a height and arranged close and opposite to the defogger with a predetermined clearance such that one side of the driven antenna is mutually coupled to that of the defogger, and a short circuit for causing a short circuit between each of the upper right and left ends of the bus bars and the window metal frame at a high frequency.

14 Claims, 4 Drawing Sheets

WINDOW GLASS ANTENNA APPARATUS FOR VEHICLES

CROSS-REFERENCE TO RELATED APPLICATION

This application is based upon and claims the benefit of priority from the prior Japanese Patent Applications No. 11-59984, filed Mar. 8, 1999, the entire contents of which are incorporated herein by reference.

BACKGROUND OF THE INVENTION

The present invention relates to a window glass antenna apparatus for vehicles which is mounted on a window glass of a vehicle such as an automobile.

There is a window glass antenna apparatus for automobiles as the most typical conventional antenna apparatuses for vehicles. This type of antenna apparatus includes a thin, narrow strip conductor provided on a window glass (usually a window glass of a rear window) of an automobile, and the conductor is employed as an antenna.

Recently a defogger has been provided almost all over the rear window glass of an automobile to serve as a heater for defogging the window glass. The antenna therefore has to be mounted in a limited space between the defogger and the window frame.

The above-described conventional window glass antenna apparatus for automobiles has a problem that its receiving sensitivity cannot be obtained sufficiently in the AM or FM band since a space for mounting the antenna is limited. The apparatus has another problem that a tuning operation for optimizing reception performance by adjusting the shape and arrangement of the antenna is difficult to perform and thus requires a long period of time.

In order to resolve the above problems, applicant has developed the following window glass antenna apparatus for vehicles and filed it as Japanese Patent Application No. 10-282870. The antenna apparatus comprises a defogger mounted on a window glass of a vehicle to defog the glass, a member for causing the defogger to serve as a slot antenna, and a driven antenna arranged close and opposite to the defogger with a given gap therebetween in such a manner that one side of the driven antenna is mutually coupled to that of the defogger.

The window glass antenna apparatus of Japanese Patent Application No. 10-282870 has the advantages that its receiving sensitivity is high across a wide frequency band and its tuning operation is easy to perform. However, it still has the following problem to be solved.

In order to cause the defogger to function as an antenna adaptable to a plurality of wide frequency bands, it is desirable to make a short circuit between the defogger and the window metal frame at a high frequency. It is thus unclear where the defogger and window metal frame should be short-circuited. Consequently, it is likely that a desired antenna characteristic will not be obtained according to the location of a short circuit.

BRIEF SUMMARY OF THE INVENTION

The object of the present invention is to provide a window glass antenna apparatus for vehicles which has the advantages that its receiving sensitivity is high across a wide frequency band and its tuning operation is easy to perform and which can be mounted exactly on a window glass of an automobile to constantly obtain a desired antenna characteristic.

To attain the above object, there is provided a window glass antenna apparatus for vehicles, comprising a defogger having a pair of bus bars and constituted of a thin, narrow strip conductor, for defogging a window glass of a vehicle, the bus bars being arranged at both side ends of the window glass and opposite to each other with a gap between a window metal frame of the vehicle and the bus bars, a driven antenna having a predetermined height and arranged close and opposite to the defogger with a clearance therebetween, one side of the driven antenna being mutually coupled to one side of the defogger, and a short circuit section for causing a short circuit between each of upper ends of the bus bars and the window metal frame at a high frequency. The short circuit section is constituted of a pair of short circuits configured to cause a short circuit between each of lower ends of the bus bars of the defogger and the window metal frame at a high frequency.

The short circuit section is constituted of a single short circuit for causing a short circuit between a lower central part of the defogger and the window metal frame at a high frequency.

The short circuit section is constituted of a pair of short circuits configured to cause a short circuit between each of middle right and left ends of the defogger and the window metal frame.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
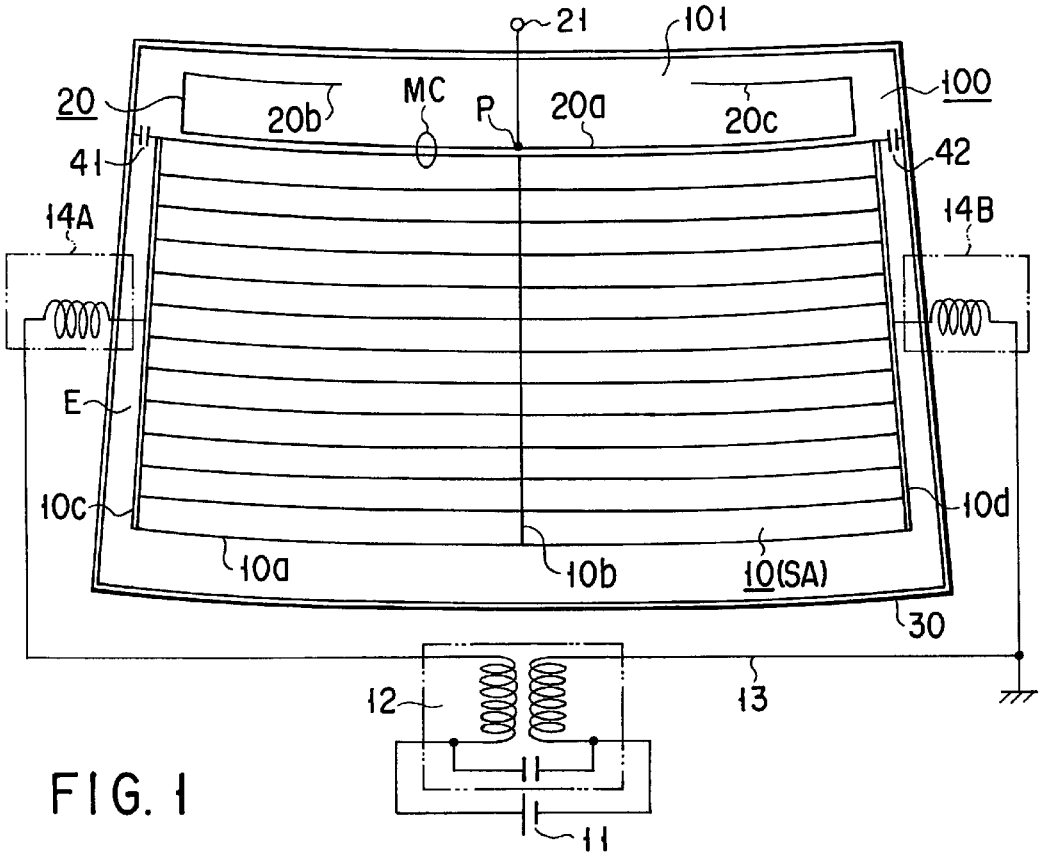
FIG. 1 is a view of the constitution of a window glass antenna apparatus for vehicles according to a first embodiment of the present invention.

FIG. 1 is a view showing the constitution of a window glass antenna apparatus for vehicles (automobiles) according to a first embodiment of the present invention. In this embodiment, the window glass antenna apparatus is applied to an antenna apparatus for receiving AM and FM radio broadcast waves. As shown in FIG. 1, a defogger 10 is formed almost all over a window glass 101 of a rear window 100 of a vehicle (e.g., an automobile) to serve as a heater for defogging the window glass.

The defogger 10 includes, as a basic pattern, a plurality of horizontal wires 10*a* arranged in parallel with one another and a vertical wire 10*b* arranged in the central part of the window glass 101 so as to cross the horizontal wires, 10*a*. The horizontal and vertical wires are each constituted of a very thin, narrow, strip conductor. The right ends of the horizontal wires 10*a* are connected together by a bus bar 10*d*, while the left ends thereof are connected together by a bus bar 10*c*. The bus bars 10*c* and 10*d* are each constituted of a strip conductor which is slightly wider than each of the wires 10*a* and 10*b*.

The defogger 10 has a mesh pattern including a number of meshes (openings) as illustrated in FIG. 1. The mesh pattern is so formed that the length of a longer side of each mesh is set considerably smaller than the wavelength (1 m or more) of a VHF band. Thus, the defogger 10 can equivalently be regarded as a single metal thin plate for received waves.

A DC power is supplied from a car-mounted battery 11 to the defogger 10 through a noise filter 12, which is constituted of a choke coil and a capacitor, for eliminating high-frequency (AM band) noise, a DC power supply line 13, and a pair of choke coils 14A and 14B having a predetermined inductance.

A node connecting one end of the choke coil 14B and that of the noise filter 12 is grounded as shown. Thus, the bus bar 10*c* is set at a high potential, while the bus bar 10*d* is set at a zero potential.

The pair of choke coils 14A and 14B separates the DC power supply line 13 from both ends of the defogger 10 at a high frequency to render these ends open at a high frequency.

A non-loop (angularly-C-shaped) driven antenna 20, which is formed by cutting part (upper central part) of a rectangular loop, is provided in an oblong region on the window glass 101 and between the top (the uppermost horizontal wire) of the defogger 10 and the upper edge of the window frame. In other words, the driven antenna 20 comprises a bottom element 20*a* adjacent to the top of the defogger, side elements 20*d* and 20*e* upwardly extending from both ends of the bottom element 20*a*, respectively, and upper elements 20*b* and 20*c* inwardly extending from upper ends of the side elements 20*d* and 20*e*, respectively, as shown in FIG. 1. Like the defogger 10, the driven antenna 20 is constituted of a very thin, narrow strip conductor. The driven antenna 20 is arranged close and opposite to the defogger 10 with a given clearance CG therebetween in such a manner that one side of the antenna 20 or the bottom element 20*a* thereof is mutually coupled to that of the defogger 10 or the uppermost one of the horizontal wires 10*a* (a coupling index K is approximately 1).

A feed point P is set in almost the middle of the bottom 20*a* of the driven antenna 20. A terminal 21 is provided at the feed point P and connected to a receiver set (not shown) through a feed cable (not shown). The driven antenna 20 is opened at both ends 20*b* and 20*c* thereof. The driven antenna 20 is opened at the ends of the upper elements 20*b* and 20*c* thereof. A mutual coupling portion MC is formed between the defogger 10 and driven antenna 20.

A short circuit 41 is provided between the upper left end of the bus bar 10*c* of the defogger 10 and a window metal frame 30 of the rear window 100 to cause a short circuit therebetween at a high frequency. Likely, a short circuit 42 is provided between the upper right end of the bus bar 10*d* and the window metal frame 30 to cause a short circuit therebetween at a high frequency.

In the short circuits 41 and 42, a capacitor of about 0.04 $\mu$F is used as a high-frequency short-circuit element.

In the window glass antenna apparatus for vehicles (automobiles) so constituted, the entire rear window 100 corresponds to an opening area of a slot antenna SA surrounded with the window metal frame 30 whose surroundings can be regarded as an ideal ground (a ground plane), and the defogger 10 functions as the slot antenna SA in the AM and FM bands. Coupling capacitance CM of the mutual coupling portion MC of the defogger 10 and driven antenna 20 arranged close to each other, is set equal to or larger than 20 PF ($CM \geqq 20$ PF). The driven antenna 20 is thus coupled to the slot antenna SA of the defogger 10 by relatively great coupling force, and their interaction decreases a radiation impedance of the driven antenna 20 or an output impedance thereof. Consequently, the frequency response in the reception band is flattened and the band is broadened.

Since the short circuits 41 and 42 are provided to make a short circuit between the upper right and left ends of the defogger 10 and the window metal frame 30 at a high frequency, the optimum radiation pattern characteristics can be obtained as is evident from analysis results of the first to fourth models which will be described later. The feed point P of the driven antenna 20 is set in almost the middle of the driven antenna 20; however, in some cases, impedance matching is easy to perform when the feed point P is slightly shifted from the middle of the antenna 20.

According to the above embodiment of the present invention, impedance matching is performed well. Therefore, most power received by the slot antenna SA of the defogger 10 is supplied to the receiver set (not shown), such as a radio, through the feed cable (not shown). The antenna gain of the antenna apparatus of the present invention is thus almost proportionate to the area of the whole window glass 101.

In the antenna apparatus described above, the receiving sensitivity (which is in proportion to the antenna gain) is increased while almost corresponding to the effective area of the antenna and, at the same time, the output impedance of the antenna can be decreased appropriately and so can be the value Q of the antenna, with the result that the frequency response is made constant and the frequency band is broadened. Consequently, the tuning operations (adjustment and modification) of the antenna become very easy to perform.

FIGS. 2 to 7 show results of radiation pattern characteristics of the four models of the window glass antenna apparatus according to the embodiment of the present invention. The antennas of the four models have different dimensions and different arrangements on the window glass.

FIGS. 2 to 5 are plan views each schematically showing the dimensions of an antenna and the arrangement thereof on the window glass 101. These figures also show antenna patterns obtained by electromagnetically analyzing a lattice model on the rear window 100 by antenna simulation using an NEC (Numerical Electromagnetic Code) based on an antenna analysis program employing a method of moment as a computational program.

In FIGS. 2 to 5, H denotes the height of the driven antenna 20, that is, the distance between the bottom element 20*a* of the driven antenna 20 and each of the upper elements 20*b* and 20*c*, and it is set to about 50 mm to 200 mm. L and R indicate the full lengths of the upper elements 20*b* and 20*c* of the driven antenna 20, and L is set to about 300 mm, while R is set to about 250 mm.

CG represents a clearance between one side (top side) 10*a* of the defogger 10 and the bottom element 20*a* of the driven antenna 20, and it is set to about 5 mm to 10 mm.

D indicates an amount of shift between the position of the feed point P and the center of the window glass 101 (the position of the vertical line 10*b*), and it is set to about 0 to ±150 mm.

BG indicates the width of an area E between each of the bus bars 10*c* and 10*d* provided at both ends of the defogger 10 and the window metal frame 30, and it is set to 20 mm or less, e.g., 17 mm. However, in the case of automobiles, the width tends to decrease gradually towards the top.

Figure 2:
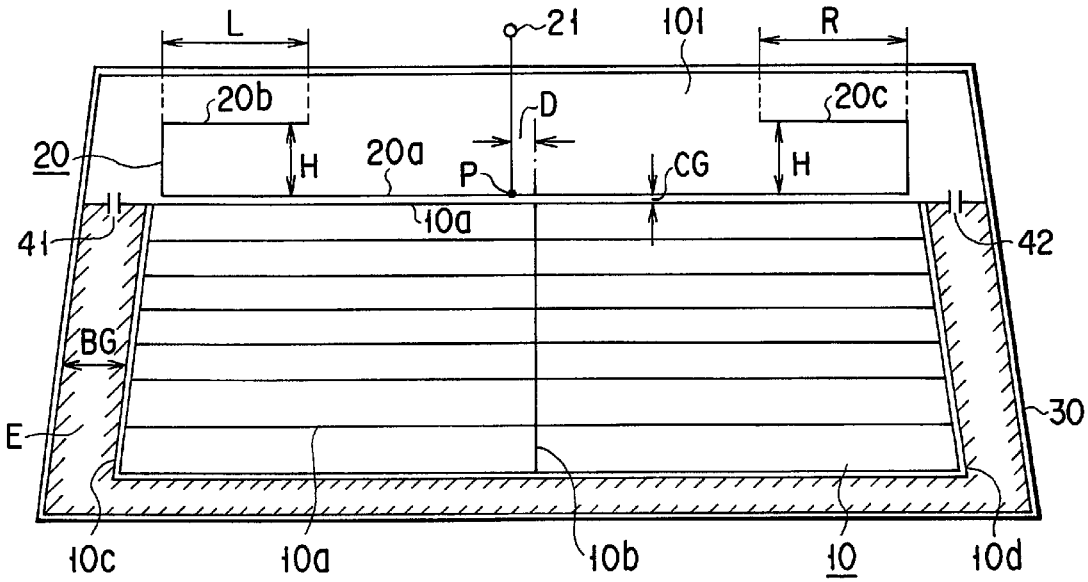
FIG. 2 is a schematic plan view of a first model of the apparatus according to the first embodiment of the present invention, which shows dimensions of an antenna and arrangement thereof on a window glass (two short circuits are arranged in the upper right and left sides of a defogger)

In the first model shown in FIG. 2, a pair of short circuits 41 and 42 is provided to make a short circuit between the upper right and left ends of the defogger 10 and the window metal frame 30 at a high frequency.

Figure 3:
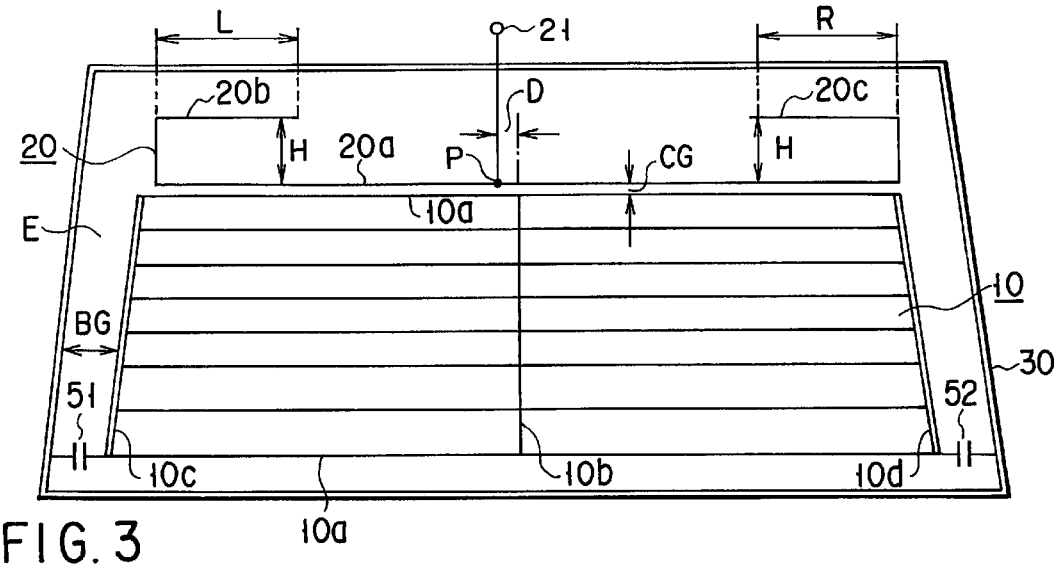
FIG. 3 is a schematic plan view of a second model of the apparatus according to the first embodiment of the present invention, which shows dimensions of an antenna and arrangement thereof on a window glass (two short circuits are arranged in the lower right and left sides of a defogger)

In the second model shown in FIG. 3, a pair of short circuits 51 and 52 (whose high-frequency short-circuit elements are the same as those of the short circuits 41 and 42) are provided to make a short circuit between the lower right and left ends of the defogger 10 and the window metal frame 30 at a high frequency.

Figure 4:
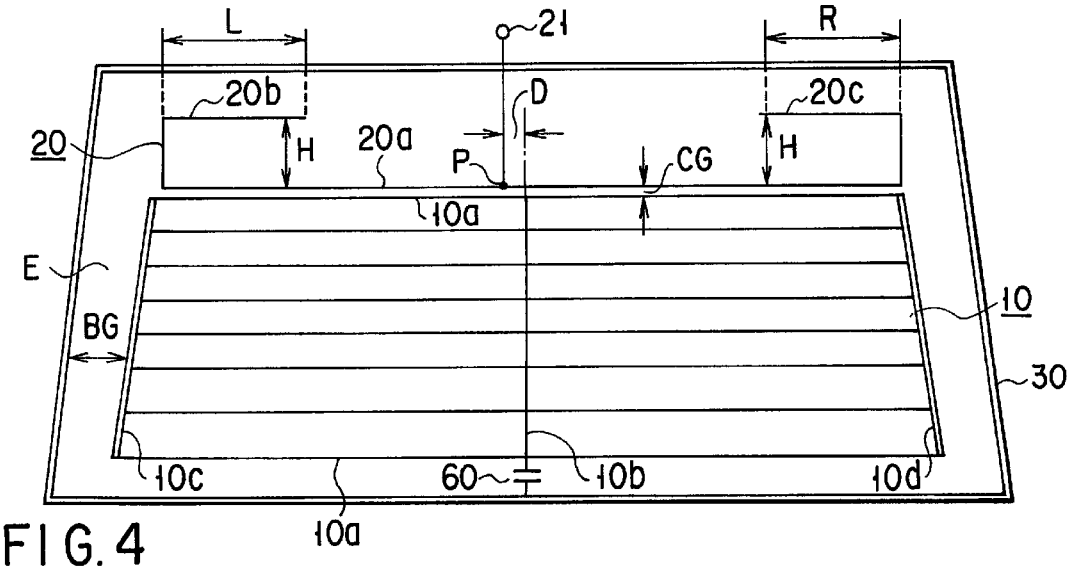
FIG. 4 is a schematic plan view of a third model of the apparatus according to the first embodiment of the present invention, which shows dimensions of an antenna and arrangement thereof on a window glass (a short circuit is arranged in the lower central part of a defogger)

In the third model illustrated in FIG. 4, a single short circuit 60 (whose high-frequency short-circuit elements are the same as those of the short circuits 41 and 42) is provided to cause a short circuit between the lower central part of the defogger 10 and the window metal frame 30 at a high frequency.

Figure 5:
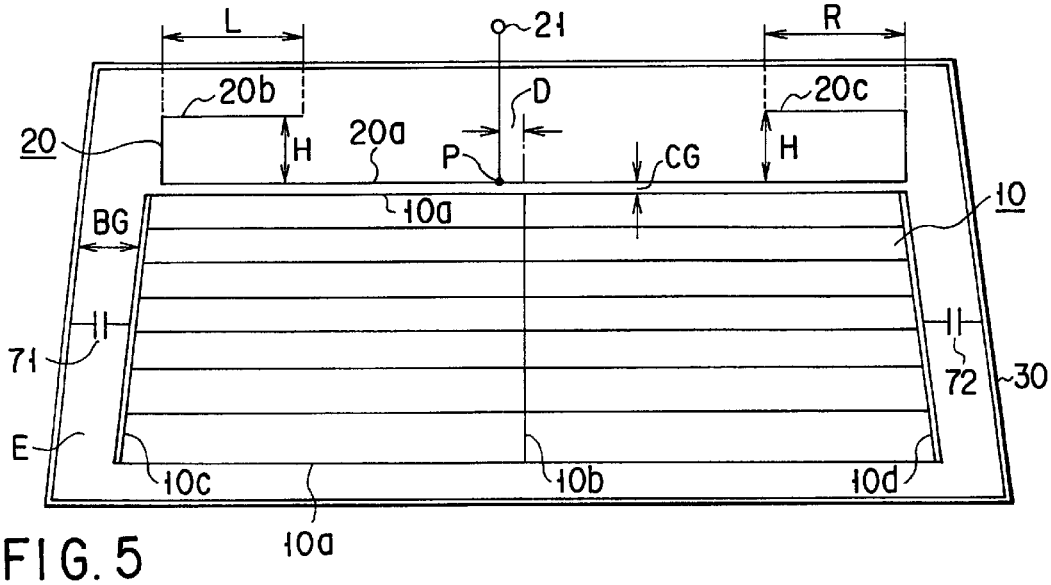
FIG. 5 is a schematic plan view of a fourth model of the apparatus according to the first embodiment of the present invention, which shows dimensions of an antenna and arrangement thereof on a window glass (two short circuits are arranged in the middle right and left sides of a defogger)

In the fourth model shown in FIG. 5, a pair of short circuits 71 and 72 (whose high-frequency short-circuit elements are the same as those of the short circuit 41 and 42) are provided to make a short circuit between the middle right and left ends of the defogger 10 and the window metal frame 30 at a high frequency.

Figure 6:
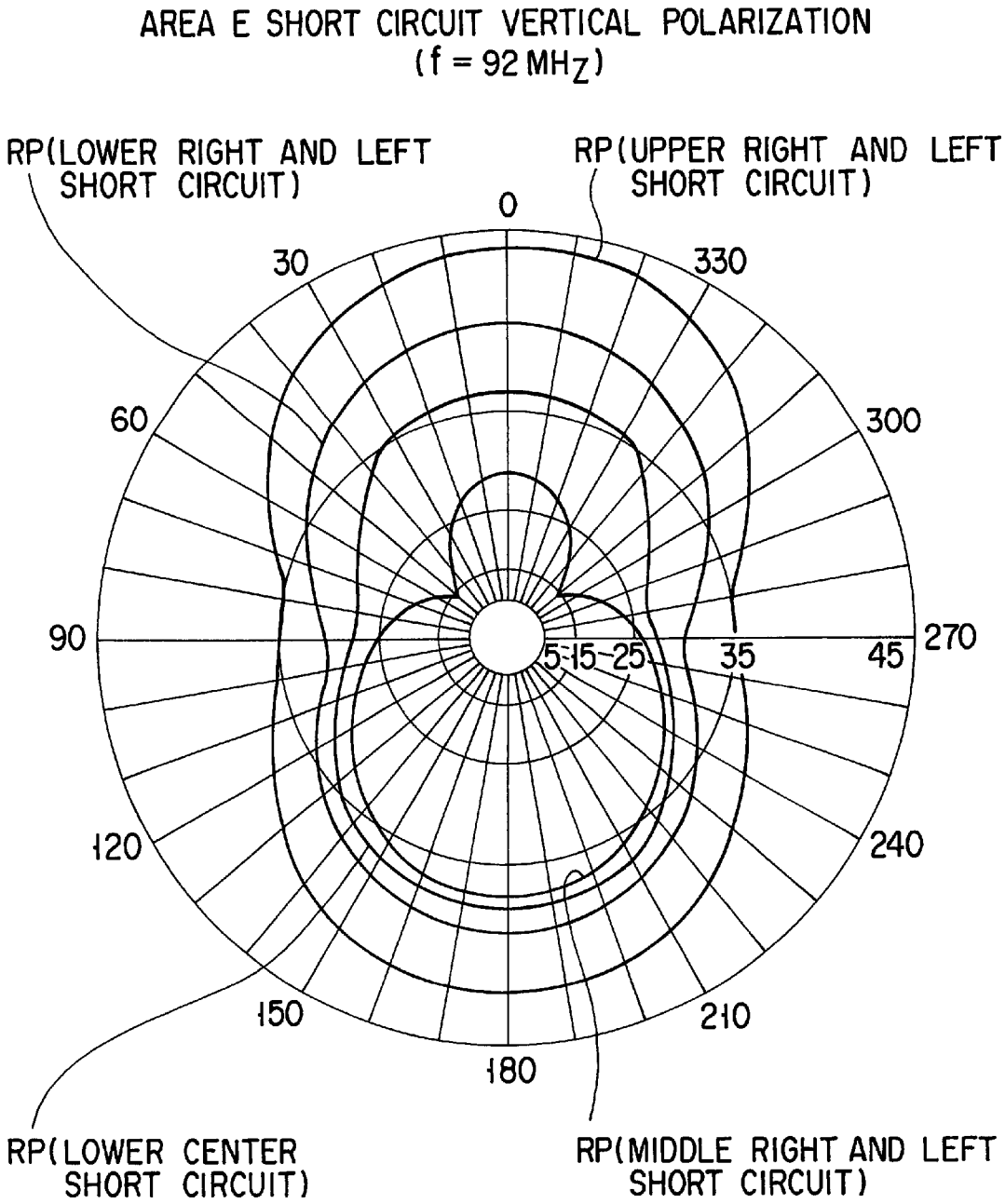
FIG. 6 is a diagram of characteristics of the window glass antenna apparatus for vehicles according to the first embodiment of the present invention, showing a vertically polarized electromagnetic radiation pattern using arrangement portions of short circuits as parameters.
Figure 7:
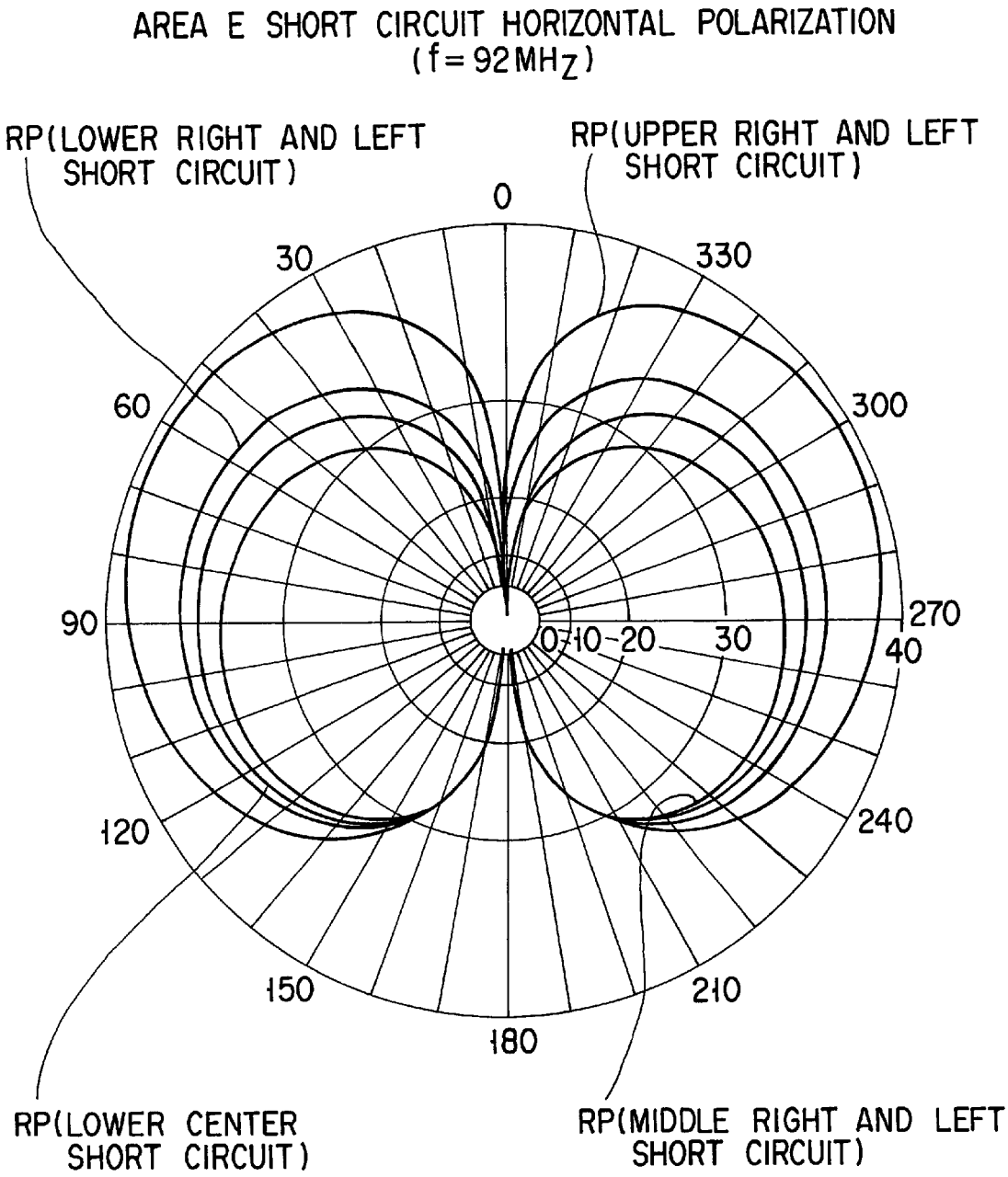
FIG. 7 is a diagram of characteristics of the window glass antenna apparatus for vehicles according to the first embodiment of the present invention, showing a horizontally polarized electromagnetic radiation pattern using arrangement portions of short circuits as parameters.

FIGS. 6 and 7 show vertically and horizontally polarized electromagnetic radiation patterns of the first to fourth models shown in FIGS. 2 to 5. These patterns are obtained based on the antenna simulation using the NEC (Numerical Electromagnetic Code).

In either of FIGS. 6 and 7, the most satisfactory radiation pattern characteristic was obtained from the first model shown in FIG. 2 in which the short circuits 41 and 42 are provided to make a short circuit between the upper right and left ends of the defogger 10 and the window metal frame 30 at a high frequency.

The second most satisfactory radiation pattern characteristic was obtained from the second model shown in FIG. 3, the third most one was obtained form the third model shown in FIG. 4, and the fourth most one was obtained from the fourth model shown in FIG. 5.

The above results were obtained for the following reason. In the first model, as shown in FIG. 2, the paired short circuits 41 and 42 are provided to cause a short circuit between the upper right and left ends of the defogger 10 and the window metal frame 30 at a high frequency. Thus, an area E between the defogger 10 and the window metal frame 30, which is diagonally shaded in FIG. 2, is used as a slot for establishing the slot antenna SA across the broadest area.

The energy obtained by the slot antenna SA is transmitted from the defogger 10 to the driven antenna 20 through a mutual coupling portion MC and then supplied to the feed point P. It has been confirmed that this phenomenon appears even when the clearance CG of the mutual coupling portion MC is zero.

The window glass antenna apparatus for vehicles according to the above embodiment can be modified as follows.

A high-potential bus bar and a window metal frame 30 are short-circuited by a short circuit using a capacitor as a high-frequency short-circuit element, while a zero-potential bus bar and window metal frame 30 are short-circuited by a short circuit using the same conductor as that of the bus bar, as a short-circuit element.

The foregoing window glass antenna apparatus for vehicles is so constituted that it can be applied to a TV antenna apparatus for receiving TV broadcast waves in the VHF band.

According to the present invention, there can be provided a window glass antenna apparatus for vehicles which the advantages that its receiving sensitivity is high across a wide frequency band and its tuning operation easy to perform and which can be mounted exactly on a window glass of an automobile to Constantly obtain a desired antenna characteristic.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A window glass antenna apparatus for a vehicle having a window metal frame and a window glass mounted on the window metal frame, comprising:

a defogger provided on the window glass and including a heater configured to defog the window glass, the defogger being assembled by a plurality of horizontal wires arranged in parallel with one another, a vertical wire crossing the horizontal wires substantially at a center of the window glass, and two bus bars, one connecting right ends of the horizontal wires and the other connecting left ends of the horizontal wires, the bus bars being arranged at both side ends of the window glass, respectively, with a gap between the window metal frame of the vehicle and the bus bars;

a driven antenna provided on the window glass and between a top of the defogger and an upper frame element of the window metal frame and having a bottom element adjacent to the top of the defogger, side elements upwardly extending from both ends of the bottom element, respectively, and upper elements inwardly extending from upper ends of the side elements, respectively, the bottom element of the driven antenna being mutually coupled to the uppermost one of the horizontal wires of the defogger with a coupling index of approximately 1; and a short circuit section configured to cause a short circuit between each of upper ends of the bus bars and the window metal frame at a high frequency.

2. The apparatus according to claim 1, wherein each of the side elements of the driven antenna has a size set to about 50 mm to 200 mm, a clearance between the bottom element of the driven antenna and the uppermost one of the horizontal wires is set to about 5 mm to 10 mm, a gap between each of the bus bars and the window metal frame is set to about 20 mm or less, and the driven antenna has a feed point at a position set to about 0 to ±150 mm with respect to a center of the window glass in a horizontal direction.

3. The apparatus according to claim 1, wherein the window glass of the vehicle is a rear window glass of an automobile.

4. The apparatus according to claim 1, wherein the short circuit section includes a short circuit caused at a high frequency between a high-potential upper portion of one of the bus bars and the window metal frame, and a short circuit caused between a zero-potential upper portion of other of the bus bars and the window metal frame through same conductor as that of the bus bars.

5. The apparatus according to claim 1, wherein the defogger includes a mesh pattern having meshes formed by the plurality of horizontal wires, the vertical wire, and the bus bars, and a horizontal side of each of the meshes is considerably shorter than a wavelength of a VHF band.

6. The apparatus according to claim 1, wherein the apparatus further comprises a noise filter configured to eliminate high-frequency noise and a pair of choke coils connected to the bus bars, respectively, and the defogger is supplied with power from a car-mounted battery through the noise filter and the choke coils.

7. The apparatus according to claim 6, wherein a node between one end of one of the choke coils and one end of the noise filter is grounded to set one of the bus bars at a zero potential and set other of the bus bars at a high potential.

8. The apparatus according to claim 1, wherein each of the bottom element, the side elements and upper elements of the driven antenna is formed of a very thin, narrow strip conductor.

9. The apparatus according to claim 1, wherein the short circuit section includes a capacitor having a capacitance of about 0.04 $\mu$F.

10. The apparatus according to claim 1, wherein the window glass entirely serves as an opening area of a slot antenna surrounded with the window metal frame, the defogger serves as the slot antenna in AM and FM bands, and the driven antenna is coupled to the slot antenna by relatively great coupling force.

11. The apparatus according to claim 1, wherein the short circuit section includes a pair of short circuits configured to cause a short circuit between each of lower ends of the bus bars of the defogger and the window metal frame at a high frequency.

12. The apparatus according to claim 1, wherein the short circuit section includes a single short circuit configured to cause a short circuit between a lower central part of the defogger and the window metal frame at a high frequency.

13. The apparatus according to claim 1, wherein the short circuit section includes a pair of short circuits configured to cause a short circuit between each of middle right and left ends of the defogger and the window metal frame.

14. The apparatus according to claim 4, wherein a short circuit is caused at a high frequency between a high-potential one of the bus bars and the window metal frame, and a short circuit is caused between another low-potential bus bar and the window metal frame through same conductor as that of the bus bars.

* * * * *